United States Patent [19]

Smith

[11] 4,064,941

[45] Dec. 27, 1977

[54] APPARATUS AND METHOD FOR MIXING SEPARATED FLUIDS DOWNHOLE

[76] Inventor: Donald M. Smith, 13282 La Vaughn Drive, Garden Grove, Calif. 92664

[21] Appl. No.: 710,886

[22] Filed: Aug. 2, 1976

[51] Int. Cl.[2] ..... E21B 43/27; E21B 43/00

[52] U.S. Cl. ..... 166/300; 166/305 R; 166/63; 166/162

[58] Field of Search ..... 166/270, 300, 305 R, 166/284, 162, 164, 169, 63, 165, 307

[56] References Cited

U.S. PATENT DOCUMENTS

| | | | |
|---|---|---|---|
| 3,045,756 | 7/1962 | Briggs, Jr. | 166/162 |
| 3,327,785 | 6/1967 | Brieger | 166/165 |
| 3,614,988 | 10/1971 | Moore | 166/63 |
| 3,727,691 | 4/1973 | Muecke et al. | 166/300 |

*Primary Examiner*—James A. Leppink
*Attorney, Agent, or Firm*—Donald W. Canady

[57] ABSTRACT

A method and apparatus are disclosed for mixing two previously separated fluids at a downhole location adjacent a predetermined formation interval.

29 Claims, 8 Drawing Figures

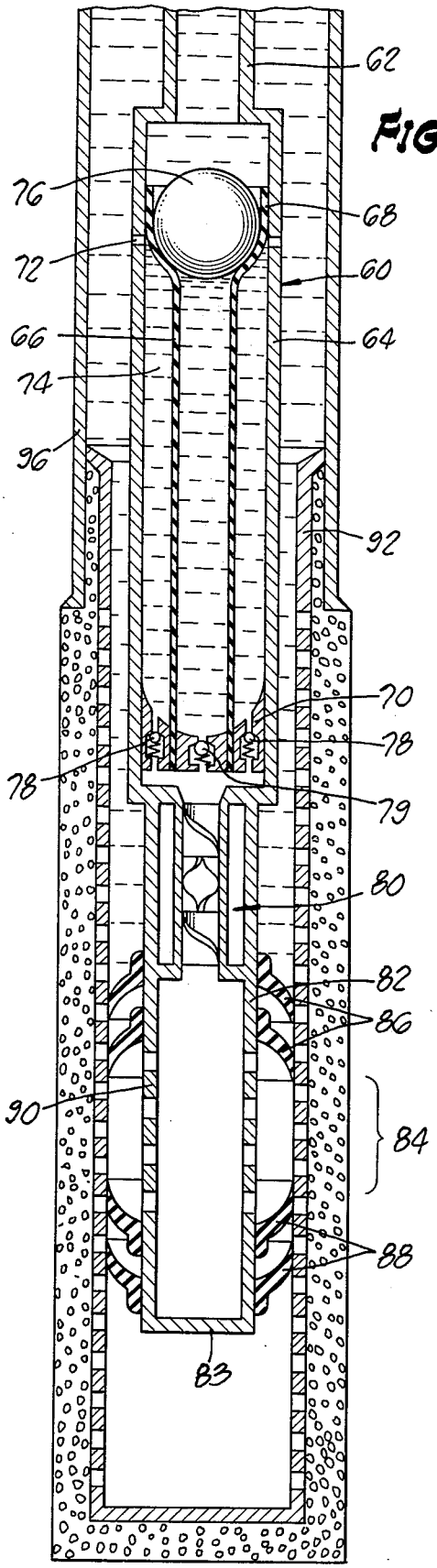
FIG. 5
FIG. 6
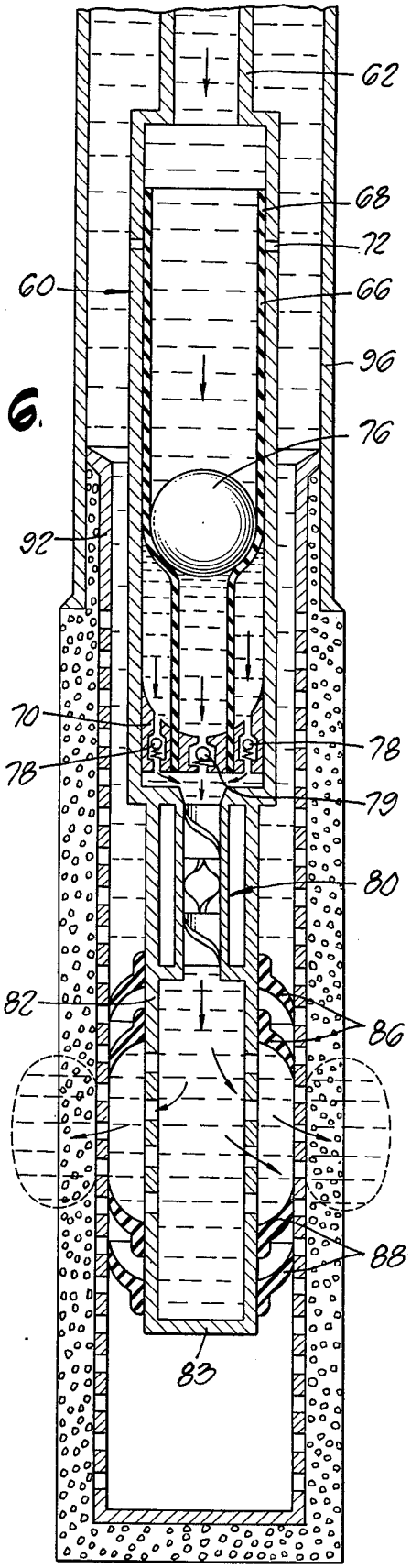

APPARATUS AND METHOD FOR MIXING SEPARATED FLUIDS DOWNHOLE

BACKGROUND OF THE INVENTION

It is desirable in certain downhole operations to inject two or more fluids into a well so that at a predetermined time and downhole location, the two fluids combine under controlled conditions to effect a desired result. For example, it is sometimes desirable to seal off the well at a certain area, either completely or partially, to prevent or restrict the flow of fluids either from or into the formation at a particular well interval or zone. It is also desirable in some well operations, particularly those of a remedial nature, to prevent vertical flow externally of a casing or liner which is set in the well. This may be done by perforating the casing or liner and injecting a cement or a sealing material from the surface down through the well and into the zone.

It is also advantageous to mix chemicals in situ for other purposes, e.g. certain downhole chemical treatments, admixtures which become explosive when mixed, while the individual chemicals are non-explosive, etc. Certain polymeric materials may be used as sealing materials for downhole applications, by admixing a polymeric material with a catalyst which gels within a predetermined time to a firm impermeable material. The time between the mixing and gelation of such chemicals, can be controlled by the proportion of the catalytic material. It has been found, however, that in such well operations where polymeric material is used to seal off a well zone, mixing the polymer and catalyst at the surface and then pumping the admixed materials down the well to the predetermined downhole location often results in premature gelation due to mechanical difficulties. On the other hand, when the gelation times are retarded greatly, the admixed materials tend to diffuse excessively into the formation and sometimes are washed away by fluid movement in the formation.

Accordingly, it is an object of my present invention to provide a method for mixing in situ two fluids pumped into a well through a tubing or drill pipe.

It is also an object of my present invention to provide a method for initially mixing two fluids downhole and subsequently emplacing the admixture with a very short gelation time, into a well formation within a relatively short time span after mixing.

It is a further object of my present invention to provide apparatus for mixing two fluids downhole and subsequently injecting the admixture into the well formation within a given time span after the two fluids are initially mixed.

It is a further object of my present invention to provide a ported sliding sleeve apparatus for mixing two initially separated fluids such as a polymeric fluid and an activator chemical downhole, by inserting a plug to move the sliding sleeve and change the port alignment of the sliding sleeve tool to effect admixture of the two fluids and subsequent injection of the admixture into the well formation.

It is also an object of my present invention to provide a ball-type mixer apparatus for admixing two fluids such as a polymeric fluid and an activator chemical, downhole, and injecting the admixture into a well formation within a predetermined time after such admixing.

BRIEF SUMMARY OF THE INVENTION

It is proposed by my present invention to provide a method for admixing two separated fluids at a downhole location by pumping the fluids through the well to the downhole location through a tubing extending into the well from the surface. Admixture of the two separated downhole fluids is effected from the concurrent discharge of the two fluids from separate chambers into a single chamber prior to injection into the formation. This is accomplished from the surface by injecting an actuating fluid which exerts mechanical pressure on the downhole tool to effect a mixture of the two previously separated fluids.

The method and apparatus of my present invention is particularly useful in connection with wells in which the production liners have been hung in open holes or have been gravel packed through the producing zone, where there exists a permeable sheath through which fluids are more or less free to migrate vertically. In some well operations of a remedial nature, it is necessary that vertical flow externally of the liner, be prevented. This is sometimes done by forcing liquid cement through the perforations in the liner with fluid pressure or by an explosive charge, either of which results in a permanent sealing of the well zone adjacent those perforations. It may, however, be preferably for this sealing to be of a temporary or non-permanent nature, such as with a sealing material which consists of polymeric fluid which when mixed with a catalyst gels into a firm impermeable mass.

The apparatus used to accomplish my aforementioned method may be of two types, the first type involving a sliding sleeve within a tool connected to the lower end of the tubing for initially isolating and subsequent admixing the fluids, and the second type of apparatus involving a tool pre-loaded with the two fluids in separate concentric containers and a ball positioned within the upper end of the tool in such a manner that it may be forced downwardly by fluid pressure exerted from the surface to expand the inner container as the ball moves down through the tool to force both fluids into a single chamber (which may contain an in-line mixer) prior to injection of the mixture into a predetermined downhole interval in the formation.

BRIEF DESCRIPTION OF THE DRAWINGS

FIG. 5 is an elevational view, in section, of a modification of the apparatus shown in FIGS. 1 to 4, for admixing two chemicals in situ proximate a predetermined formation interval, in accordance with my present invention.

FIG. 6 is an elevational view, in section, of the apparatus shown in FIG. 5 showing the manner in which the tool is operated to effect the admixture of the two chemicals.

DETAILED DESCRIPTION OF THE INVENTION

Figure 1:
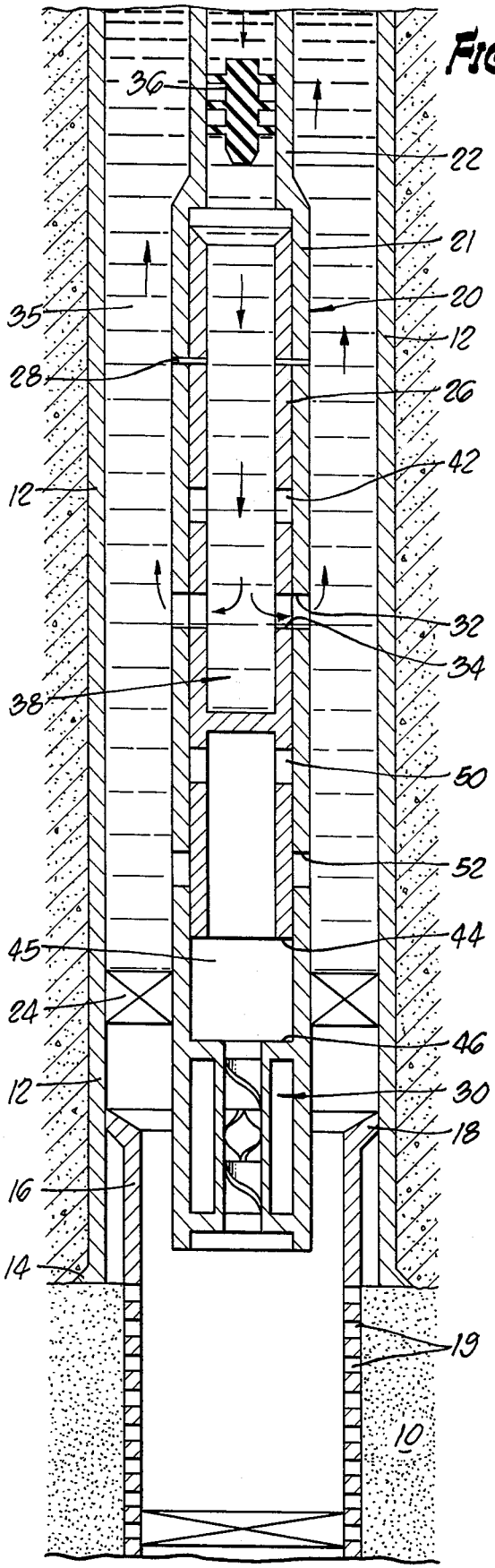
FIG. 1 is an elevational view, in section, taken through an injection tool of my present invention emplaced in a cased well in a formation prior to the injection of the chemical mixtures.

In reference to a preferred embodiment of my invention, an oil well is shown in FIG. 1 drilled information 10, with an oil well casing 12 cemented in the formation with a casing shoe 14. A well liner 16 is hung within the casing 12 on a liner adaptor 18 and perforated or slotted at 19 in accordance with conventional oil well techniques. An injection tool 20 is attached to the bottom of the tubing or drill string 22 which is used as a pump down string in accordance with the embodiment of my present invention illustrated in FIGS. 1 through 4. The injection tool 20 is packed off in the liner 16 or in the casing 12 (as shown) with a packer 24, to confine movement of fluids flowing through the tool 20 into the liner 16. Various other combinations of packers may be provided both above the below the injection tool in accordance with my invention, confine the injected fluids to the desired interval(s) in the well.

Figure 2:
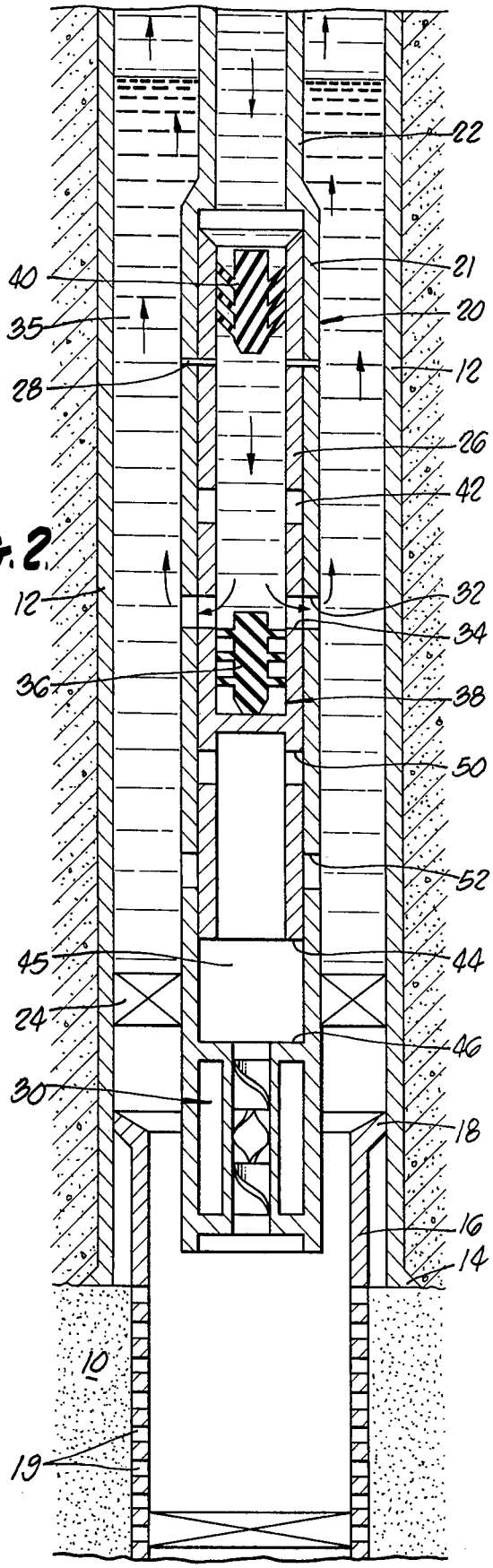
FIG. 2 is also an elevational view of the apparatus shown in FIG. 1, showing the two separated chemicals in the injection tool prior to their admixture in accordance with my present invention.

The injection tool 20 shown in FIGS. 1 - 4 comprises a shell or body 21 with a ported sliding sleeve 26 therein, which is initially shear pinned to the body 121 of tool 20 with shear pins 28, as shown in FIGS. 1 and 2. An in-line static mixer 30 may be operatively attached to the lower end of the injection tool 20, to intimately mix the two previously separate fluids after they are admixed. The mixed fluids pass through the static mixer 30 portion of tool 20, and into the formation 10 through the perforated liner 19, as discussed below. After the mixing - injection tool 20 is attached to the lower end of the tubing or drill pipe 22 (the pump-down string) it is lowered through the well and into the upper end of a liner 16, which is hung within the lower end of the casing 12. A well fluid such as a drilling mud, completion fluid, etc. may be circulated from the surface through the pump-down string 22, and tool 20 is indicated by downwardly directed arrow, and passes through matching ports 32 and 34 of the mixing-injection tool 20 and sliding sleeve 26 respectively, into the annulus 35 between the tubing string 22 and casing 12. When it is desired to inject chemicals into the formation, a first plug 36 which is a conventional rubber plug, for example, a plug consisting of a solid core with attached flat disc flanges, is inserted into the top of the tubing or pump-down string 22. Plug 36 prevents mixing of the well fluid below the plug, with the first chemical fluid which is pumped into the pump-down string 22 after the plug 36 is inserted into the string 22.

As the first chemical is pumped into the hole, behind plug 36, the plug moves down through the pump-down string 22 and into the tool 20 where it seats in pocket 38. Plug 36 is of the type which, when stopped by an obstruction, will collapse and allow fluid to flow past the plug. While plug 36 is a fluid separation plug, fluid will not normally bypass plug 36, unless an obstruction is contacted in which case bypassing of fluid may occur.

After plug 36 comes to rest in pocket 38, i.e. after the predetermined quantity of first chemical has been pumped into the well and out into the annulus 35, a second plug 40, as shown in FIG. 2, is inserted in the pump-down string and the second chemical pumped into the string behind plug 40 to move the second plug 40 downhole into the tool 20. The second plug 40 acts as a fluid separation plug as the first chemical fluid is run down the pump-down string, through the tool 20 and out the ports 32 and 34 into the annulus between the tubing string and the casing. Plug 40 is of a different design than plug 36 in that fluid cannot bypass plug 40. Plug 40 may be of the type described in the 1974–1975 Composite Catalog of Oil Field Equipment and Services, on page 2405 as a top plug, but may also be called a closing plug. Plugs 36 and 56, on the other hand, are shown in the above 1974–1975 Composite Catalog on page 2405 as a bottom plug, but are also sometimes called by-pass plugs.

Fluid flowing downwardly in the pump-down string 22, forces plug 40 down through the tool 20 until it comes to rest on top of the first plug 36 in its position shown in FIG. 2.

Figure 3:
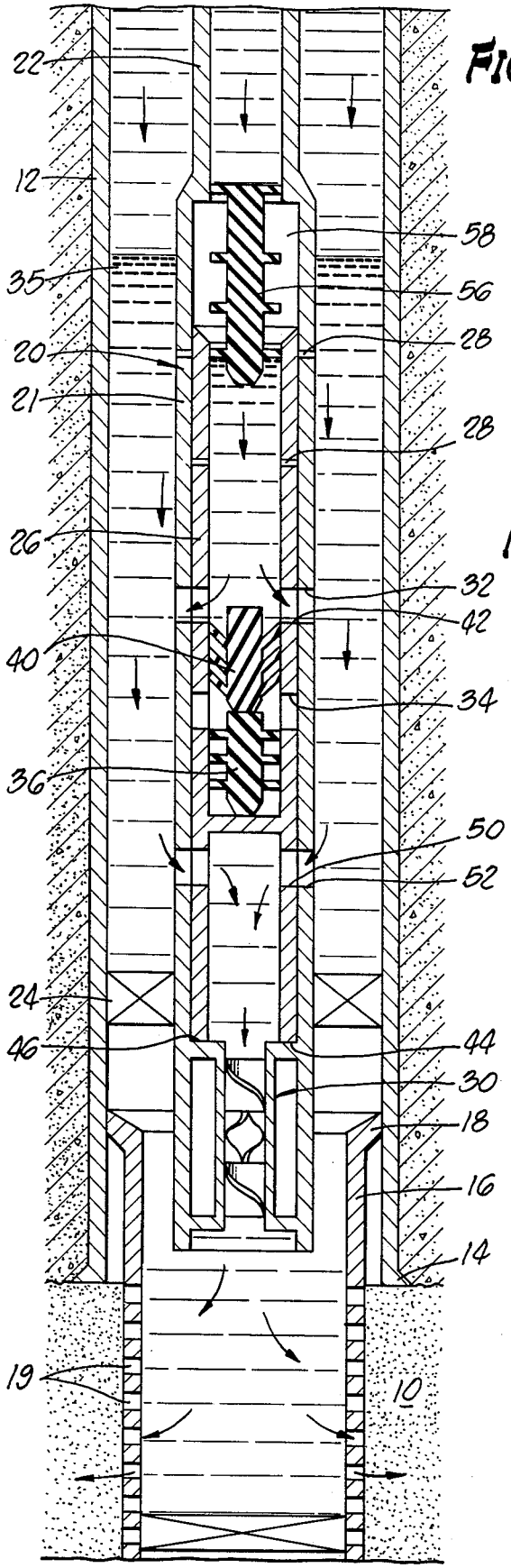
FIG. 3 is another elevational view of the apparatus shown in FIGS. 1 and 2, showing the operation of the injection tool which results in the admixture of the two separated fluids downhole.

Further movement of plug 40 requires pressure sufficient to shear pin 28 which then allows the inner sleeve 26 to slide downwardly until the lower end 44 of the sleeve 26 seats on surface 46, at the top of the static mixer 30, thus aligning port 42 of the sliding sleeve with port 32, of the injection tool. This port alignment permits the second chemical which had been previously separated from the first chemical by the second plug 40, to admix therewith by flowing through the aligned ports 32 and 42 into the casing annulus 35 as shown in FIG. 3. When plug 40 initially comes to rest on top of plug 36, the second chemical fluid which is above plug 40, is blocked by plug 40 from flowing outwardly through the aligned ports 32 and 34. However, continued pressure on the column of fluid above plug 40, shears the pin 28, and the sliding sleeve 26 moves downwardly as mentioned above.

The additional fluid pressure required to force plug 40 downwardly sufficient to shear pin 28, is not exerted until it is desired to mix the two chemical fluids.

Following the admixture of the two fluids by moving the sliding sleeve 26 downwardly to line up port 42 of the sliding sleeve with port 32 of the tool body the admixed fluids move downwardly through the annulus 35 and back into the tool 20 through the aligned ports 50 and 52, and downwardly through a common chamber 53 and an in-line mixer, e.g. the static mixer 30 shown, and then through the slotted liner 18 and into the formation 10.

Figure 4:
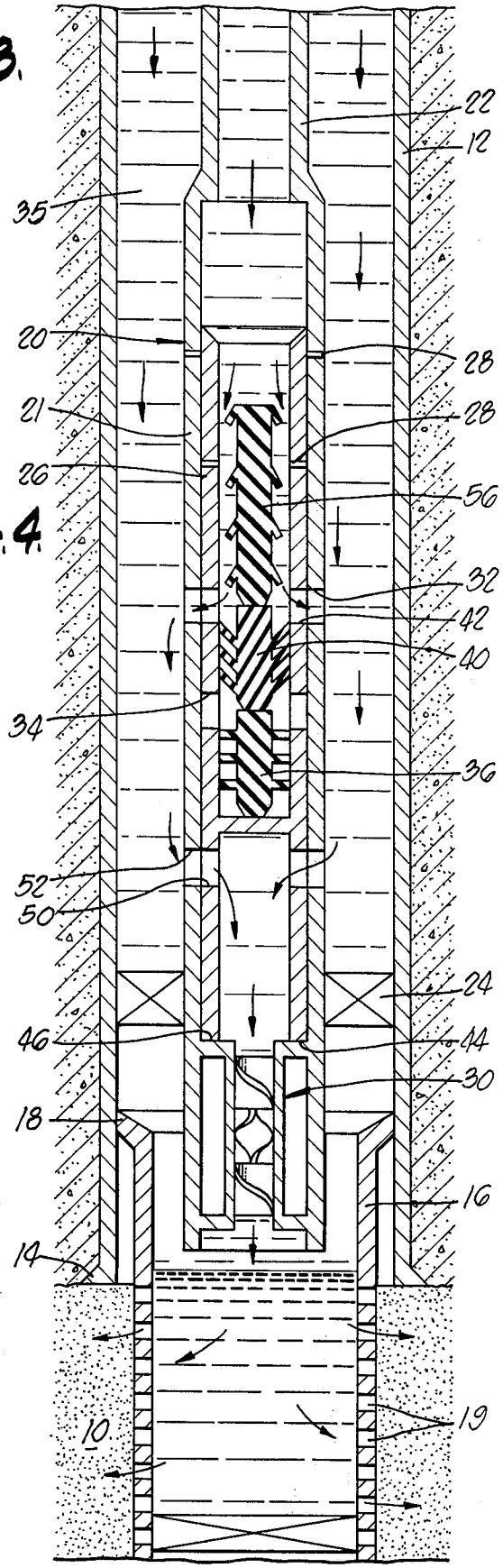
FIG. 4 shows the apparatus of FIGS. 1 – 3 with the admixed chemicals being injected into the formation with a well fluid.

After a predetermined amount of the second chemical fluid has been injected into the pump-down string 22, a third plug 56 is inserted in the pump-down string and hence will enter the injection tool 20 behind (above) the second chemical fluid, as shown in FIG. 3. The plug 56 is forced down the pump-down string by the injection of well fluid into the tubing string 22 at the surface. Plug 56 is thus a fluid separation plug, although it is longer than plugs 36 and 40 since it must span the open area 58 in the tool body 21 above the sliding sleeve 26 after the sleeve has moved downwardly as shown in FIGS. 3 and 4. When plug 56 reaches the tool as shown in FIGS. 3 and 4, all of the chemical fluids will be at or below the tool since plug 56 forces the chemical fluids ahead of the well fluid and separates the chemical fluid from the well fluid.

Before the pin 28 is sheared and the sliding sleeve 26 is moved downwardly, fluid from the annulus 35 cannot pass back into the tool 20 through its lower port 52, since as shown in FIG. 1 and 2, port 52 is not aligned with an opening or port in the sleeve 26. However, when the pin 28 is sheared and sleeve 26 is moved downwardly to admix the first and second chemicals in the annulus 35 as discussed above, the lower ports 50 of the sliding sleeve moves into alignment with lower ports 52 of the tool body so that fluids from the annulus 35 may then flow into the lower portion of tool 20 as shown in FIGS. 3 and 4 by arrows, through chamber 52 and the static mixer 30 and into the formation through slots 19 in the slotted liner 18. A well fluid is pumped from the surface down the casing annulus 35 as well as the pump-down string 22, after the pin 28 is sheared to force the admixed chemical in annulus 35, downward through the lower section of tool 20 through alignment ports 50 and 52, through mixer 30 and into the formation.

After plug 56 reaches the tool and comes to rest on top of plug 40 as shown in FIG. 4, additional well fluid may be pumped past plug 56 to clear or displace all of the chemical fluids from the well. The well can also be cleared of chemical fluid by injecting fluid into the well through the casing annulus 35.

After the chemical has been cleared or displaced from the well (if desired), the chemical injection operation is completed and after sufficient time has elapsed to complete the desired chemical treatment of the well, or formation interval, (e.g. for the polymer to gel), the tool 20 is removed from the well by pulling the pump-down string 22.

One type of sealing materials requiring controlled gelling time and with which my present method and apparatus may be used, are the polymeric gell forming fluids, e.g. polyacrylamide, polethylbutylene, polyethylene oxide or polyisobutylene, plus a conventional cross-linking catalyst and/or activator, which is the second chemical referred to above. Obviously, my present method and apparatus may also be used to mix in situ, other previously separated chemicals, as mentioned above.

Figure 7:
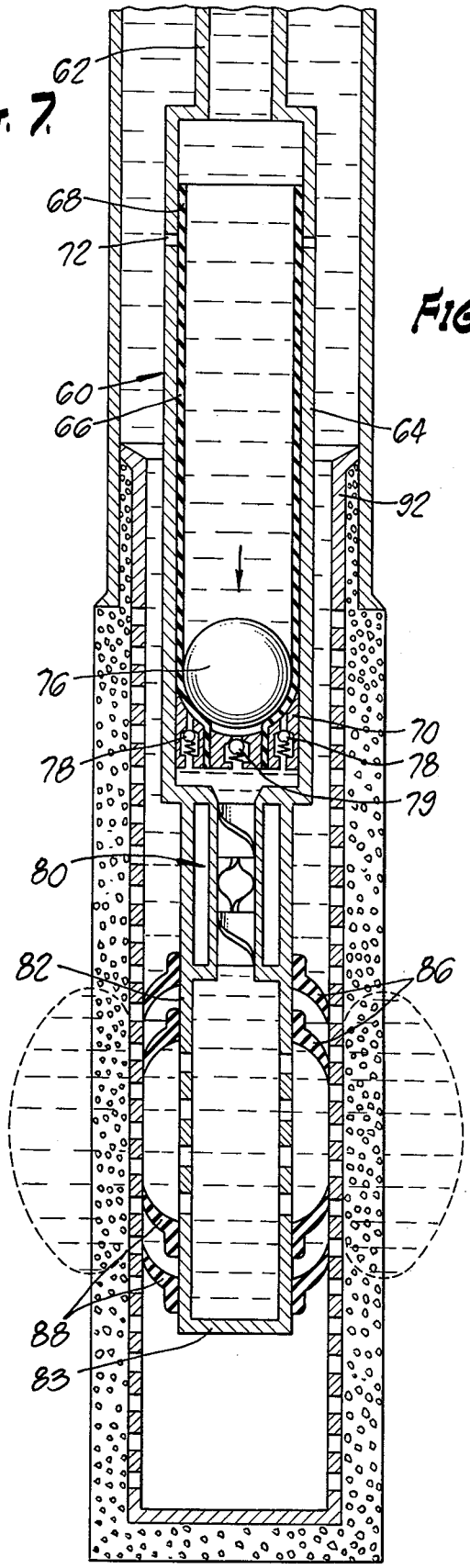
FIG. 7 is an elevational view, in section, of the apparatus shown in FIGS. 5 and 6 at the completion of the admixture of the two fluids.

Another embodiment of my present invention is shown in FIGS. 5 – 7. FIGS. 5 – 7 show a ball-type injection tool for mixing separated fluids downhole. While both the sliding sleeve type tool shown in FIGS. 1 – 4 and the ball-type tool shown in FIGS. 5 – 7 accomplish the same purpose, that is to mix two separate fluids downhole, the ball-type tool minimizes the contamination of the chemical fluids with well fluids and lends to greater accuracy in the amounts of the two chemicals which are injected. The ball-type mixture, however, is more limited as to the quantity of chemical fluids which may be injected, since it is essentially a batch type operation, whereas the sliding sleeve tool may be either batch or continuous.

FIG. 5 shows the ball-type injection tool 60 attached to the lower end of a pump-down string 62. The injection tool 60 comprises an enlarged outer shell or body portion 64 in which an elastic tube 66 is affixed with the tubular body 64, at its upper and lower ends. The tube 66 is preferably affixed to the body 64 by rivets or bonding to the inner surface of the body 64 at 68 and may be suitably bonded to the base plate 70 at the bottom of tubular body 64. Preferably the elastic tube 66 is reinforced longitudinally as with embedded longitudinal cloth or metal strips, so that the tube is expansible in diameter but not in length. Vent holes 72 are provided near the top of the tubular body 64 to relieve any differential pressure between the elastic tube 66 and the annulus as the fluid pressure in the pump-down string 62 is released, after the operation of the injection tool is completed.

The injection tool shown in FIGS. 5 may be made up at the surface by filling the elastic tube 66 with a predetermined amount of one chemical and the annulus 74 between the elastic tube 66 and the body of the tool 64 with a measured amount of the second chemical. As shown in FIG. 5, a rigid ball 76 of approximately the same diameter as the internal diameter of the tubular body 64 is positioned in the tool near the upper end of body 64 within the elastic tube 66. The elastic tube 66 is tightly sealed to the outer shell 64 at both the top and the bottom of the tube and holds the ball 76 at the top of tube 66 preparatory to injection of well fluids through the pump-down string 62 to force the ball 76 downwardly. The baseplate 70 of the tubular body 64 is provided with springloaded one-way valves 78 in the annulus and a similar valve 79 in the baseplate below the tube 66. The tension on the springs of valves 78 and 79 is such that they do not open unless a predetermined fluid pressure is exerted above the displacement ball 76. The diameter of the elastic tube 66 is selected so that the crosssectional area of the annulus 74 bears the same relationship to the cross-sectional area of the elastic tube as the desired relationship between the relative volumes of the two chemicals to be admixed.

The static mixer 80 is of the type described in connection with the apparatus of FIGS. 1 – 4, i.e. mixer 30. Basically, this mixer is an in-line mixer of conventional design, e.g. the "static mixer" sold by Kenics Corporation of Danvers, Mass. and described in their Bulletin No. SM5A, or the static mixers of Koch Engineering Company, Inc. The mixer shown at 80 (and 30) is a tubular chamber containing a series of short vanes which give fluid passing through a rotational flow. Each vane is set at right angles to the next adjoining vane and each vane is curved to provide a rotational flow in the opposite direction to each adjoining vane. The effect of the static mixture is to split the stream of fluid passing each vane as it flows through the tube, which results in a multiplicity of splits so that as the two fluids pass through the mixture, they will become homogeneously and intimately mixed. Other in-line mixers may also be used with my present invention.

The lower section 82 is an extension of the tubular member 80 which contains the static mixer 80. The tubular extension 82 is closed at the bottom 83 and has a perforated interval 84 to permit the passage of fluids out of the tool into the formation. The injection section 82 of the tool is equipped with a double set of swap cup packers 86 and 88 at the top and bottom of the perforated section, as shown, the top set of packers 86 opening downward and the lower set 88 opening upwards. These swab cups seal the annulus between the tailpipe 90 and the perforated liner 92 or casing 96 and prevent vertical migration of the fluids in the hole. This lower section may also have a bypass valve (not shown) to reduce friction of the swab cups as the tool is run into the well through casing 96.

Figure 8:
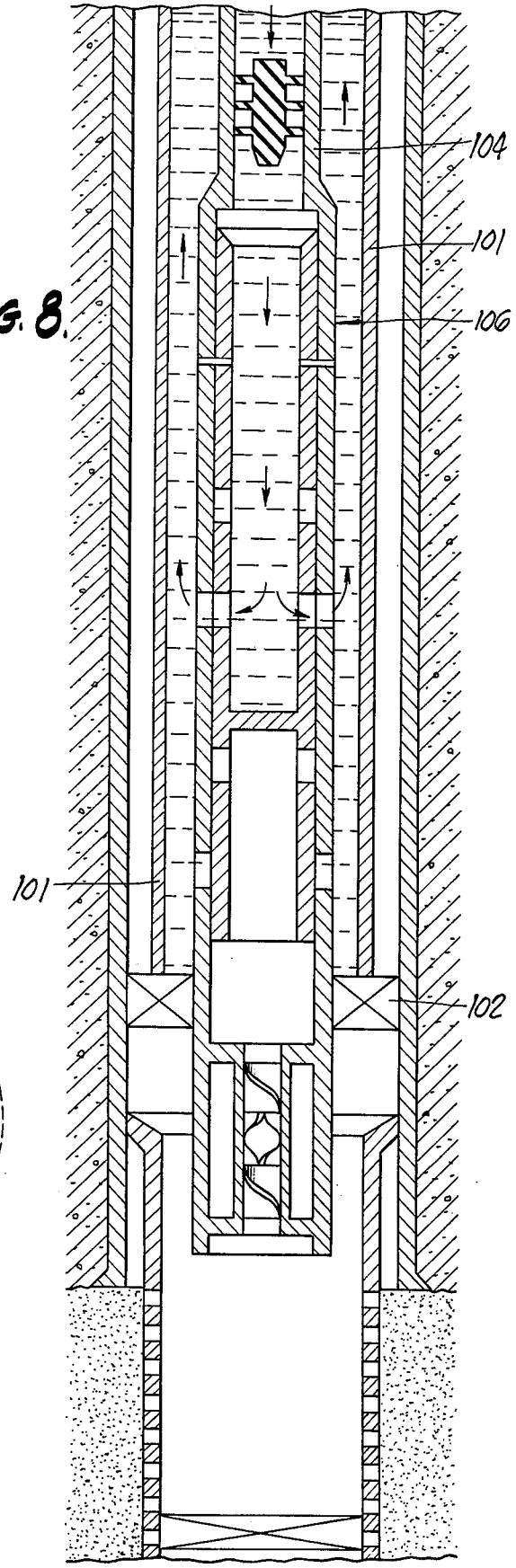
FIG. 8 is an elevational view showing the tool shown in FIGS. 1 - 4 used with a second tubing string.

The tool 60 is assembled as shown in FIG. 5 at the surface or on the rig floor, with the swab cups and tool being selected for the correct size of liner or casing with which the tool is to be used. The drill pipe or tubing (pump-down tube) is attached to the top of the tool 60 and run into the well on the pump-down string 62. When the swab cups 86 and 88 are positioned across the formation interval to be injected, a pump at the surface (not shown), is connected to the top of the pump-down string 62 and water or other fluid pumped down the pump-down string 62 into the top of the tool 60. The pressure created by the pump on the fluid in the string, forces the ball 76 down the inner tube 66 thus forcing the chemical within the elastic tube 66 outwardly through valve 79 and and the chemical in the annulus 74 is simultaneously forced out of the annulus 74 through the valves 78 in the baseplate. The two chemicals are thus intermingled just below the baseplate and forced through the static mixer 80 where they are mixed intimately and passed down through the tube extension 82 and through the perforations in the liner 90 as shown in FIG. 6, and into the formation. When the ball 76 reaches the baseplate 70 at the bottom of the tube 66 as shown in FIG. 7, it blocks any further fluid movement through the tool and prevents contamination of the chemicals with the pump down fluid. When the ball 76 reaches the baseplate 70 as shown in FIG. 7, and the gelation time is spent, the operation is completed and the tool 60 may be removed. FIG. 8 shows a further embodiment of my present invention with a second string of tubing through which the pump-down string is run concentrically. This embodiment is shown with the sliding sleeve type injection tool. The packer 102 in FIG. 8 is run in the well on the outer string and may be set in the casing as required. The inner pump down string 104 is then run into the outer string and threaded into the top of the sliding sleeve assembly 106 or the packer 102. The sliding sleeve assembly may be run in attached to the packer or on the pump-down string. This double string arrangement offers the additional advantage that it may be run into the hole dry (empty) and thus avoid any contamination of the chemicals with the well fluid. This advantage is particularly important where the chemicals to be injected are of a lower specific gravity than the well fluid or when the well is drilled at a relatively high angle of deviation from the vertical, i.e. over about 45°.

While my present invention has been described herein with a certain degree of specificity with respect to the preferred embodiments illustrated, it is to be understood that the scope of my invention should not be limited to the description hereinabove set forth, but rather should be afforded the full scope of the appended claims.

I claim as my invention:

1. Apparatus for admixing within a predetermined time span, two separated fluids downhole in tubular apparatus in a cased well through which tubing extends within said casing from said tubular apparatus to the surface, comprising:

means within said tubular apparatus defining a first fluid compartment, means within said tubular apparatus defining a second fluid compartment, means within said tubular apparatus for separating fluids contained in said first and second compartments, means including a displacement fluid actuatable from the surface through said tubing for displacing said separating means downhole to permit downhole admixture of the fluids in said first and second compartments, said tubular apparatus including a ported tubular member which is affixed to the lower end of said tubing and in fluid communication with said tubing, and a ported sliding sleeve movably disposed within said tubing member for displacing said separating means to admix said first and second fluids in said tubular apparatus, and an in-line mixer adjacent the lower end of said tubular apparatus for intimately mixing said admixture preparation to injection of said mixture into a well zone.

2. The apparatus of claim 1 wherein a perforated liner is hung in the lower end of said casing and said tubular apparatus and mixer extend therein and packing means are inserted in the annulus between said tubular apparatus and said casing above said well zone.

3. The apparatus of claim 1 wherein said separating means are displaced with a spherical member subjected to fluid pressure from the surface through said tubing.

4. Apparatus for admixing downhole within a predetermined time span, first and second separated fluids injected downhole through tubing extending to the surface through a cased well, comprising in combination:

a tubular member affixed to the lower end of said tubing and in fluid communication with said tubing, said tubular member having first and second longitudinally spaced ports, a sleeve axially slidable within said tubular member, and having a first port initially aligned with said first port of said tubular member to permit said first fluid to pass through said tubular member in the casing annulus, separating means movable within said tubular member for separating said first fluid injected through said tubing into said tubular member, from said second fluid injected through said tubing into said tubular member, means for moving said sleeve axially within said tubular member at a predetermined time to align a second port of said sleeve with said first port of said tubular member and admit said second fluid into said casing annulus, and means for injecting said admixed fluids into a predetermined well zone below said tubular apparatus.

5. The apparatus of claim 4 wherein said separating means prevents flow of said second fluid through said initially aligned ports into said casing annulus.

6. The apparatus of claim 4 including means for passing said admixed first and second fluids back into said tubular member below said separating means.

7. The apparatus of claim 4 including means for passing said admixed fluids through an in-line static mixer prior to injection of said admixed fluids into said well zone.

8. The apparatus of claim 4 including means in said tubular member for stopping said separating means between the first and second ports of said sleeve.

9. The apparatus of claim 8 wherein a third port is provided in said sleeve below said stopping means and positioned to align with said second port of said tubular member when said second port of said sleeve is aligned with said first port of said tubular member, to provide a path for said admixed fluids to pass from said casing annulus to said well zone.

10. The apparatus of claim 4 including pack-off means in said annulus between said casing and said tubular member, below said second port in said tubular member.

11. The apparatus of claim 4 including shear pin means for temporarily holding said sleeve in said tubular member with said first port of said sleeve aligned with the first port of said tubular member.

12. The apparatus of claim 4 wherein said separating means is a closing plug.

13. The apparatus of claim 4 wherein a first fluid separation plug is positioned in said tubing before said first fluid is injected to said tubing and a second fluid separation plug is positioned in said tubing after said second fluid is injected into said tubing.

14. Apparatus for admixing downhole within a predetermined time span, first and second separated fluids in a cased well through which tubing extends to the surface, comprising in combination.

a tubular member affixed to the lower end of said tubing and in fluid communication with said tubing, a second flexible tubular member of smaller diameter, positioned concentrically within said tubular member, the annulus between said tubular member and said flexible tubular member defining a first fluid chamber for said first fluid, and the interior of said flexible tubular member defining a second fluid chamber for said second fluid, means for sealing said flexible tubular member to said tubular member proximate the top and bottom of said tubular member to sealingly separate said first and second fluid chambers, valve means in said first and second fluid chambers for passing said fluids from said fluid chambers, means for displacing said first fluid from said first fluid chamber and simultaneously displacing said second fluid from said second fluid chamber, whereby said first and second fluids are discharged from said chambers into a common mixing area, and means for injecting said admixed fluids into a predetermined zone in said well.

15. The apparatus of claim 14 including a tubular extension affixed to said tubular member below said common mixing area and means in said tubular extension for intimately mixing said admixed fluids before they are injected into said well zone.

16. The apparatus of claim 15 wherein said mixing means are an in-line static mixer.

17. The apparatus of claim 14 including means for confining said injected fluid admixture to said predetermined well zone.

18. The apparatus of claim 17 wherein said confining means comprise a pair of packer cups.

19. A method for admixing two separated fluids downhole in tubular apparatus in a cased well through which tubing extends from said tubular apparatus to the surface, comprising the steps:

a. injecting a first chemical fluid through said tubing into a first fluid compartment within said tubular apparatus, b. injecting a second chemical fluid through said tubing in a second fluid compartment within said tubular apparatus, c. displacing means separating said first and second fluids proximate said downhole location, d. intimately mixing said admixture, and e. emplacing said intimately mixed admixture in a predetermined well zone within a predetermined time span.

20. The method of claim 19 including the step of injecting well fluid into the casing-tubing annulus to emplace said admixture into said well zone.

21. A method for admixing within a predetermined time span, first and second separated fluids downhole through a tubular member positioned downhole and from which tubular member tubing extends to the surface through a cased well, comprising the steps:

a. injecting a predetermined amount of said first fluid into said tubular member through said tubing from the surface and into the annulus surrounding said tubular member, through a first port in said tubular member aligned with a first port in a sliding sleeve which is concentrically disposed within said tubular member, b. inserting a closing plug in said tubing at the surface, injecting a predetermined amount of said second separated fluid into said tubing after said first fluid separation plug, d. forcing said second fluid and said closing plug through said tubing until said closing plug effectively closes off said aligned ports to said second fluid and prevents entry of said second fluid into the annulus surrounding said tubular member, e. moving said sliding sleeve downwardly in said tubular member so that a second port in said sliding sleeve positioned above said first port of said sliding sleeve, aligns with said first port in said tubular member to provide a path for said second fluid to enter said annulus surrounding said tubular member, and f. pumping a third fluid down the annulus between the casing and the tubing to force the admixed first and second fluids downwardly into a predetermined well zone below the downhole position of said tubular member.

22. The method of claim 21 wherein said admixed fluids are passed through an in-line static mixer to intimately admix said fluids prior to injection of said admixture into the well zone.

23. The method of claim 21 including the step of inserting a fluid separation plug into said tubing after said second fluid has been injected into said tubing, and forcing said second fluid and said second fluid separation plug down throughthe tubing with a well fluid injected after said fluid separation plug.

24. The method of claim 21 including the step of inserting a first fluid separation plug into said tubing before said first fluid is injected into the tubing, to separate said first fluid from said well fluid intially present in said tubing.

25. A method for admixing within a predetermined time span, first and second separated fluids downhole through a tubular member positioned downhole and from which tubular member, tubing extends to the surface through a cased well, comprising, the steps:

a. packing off the annulus between said tubular member and said casing proximate the lower end of said tubular member, b. inserting a first fluid separation plug into said tubing, c. injecting a predetermined amount of said first fluid into said tubing, d. inserting a closing plug into said tubing after said predetermined amount of first fluid is injected into said tubing, e. injecting a predetermined amount of a second fluid into said tubing, and forcing said first and second fluids separated by said closing plug, down through said tubing and into said tubular member and said first fluid flowing out through aligned ports in said tubular member and an axially sliding sleeve concentrically disposed within said tubular member, and into the annulus surrounding said tubular apparatus, with said closing plug preventing said second fluids from passing through said aligned ports into said annulus, f. exerting additional fluid pressure through said tubing on said second fluid to move said sleeve downwardly in said tubular member and thereby open a second port opening in said tubular member above said closing plug to allow said second fluid to be forced out said second port opening and into said annulus, and h. exerting fluid pressure in said annulus from the surface to force said admixed fluids downwardly in said annulus and into a predetermined well zone.

26. Apparatus for admixing within a predetermined time span, two separated fluids downhole in a cased well into which a tubing extends within said casing from the surface, comprising:

tubular apparatus connected to the lower end of said tubing and in fluid communication therewith, means within said tubular apparatus defining a first fluid compartment, means within said tubular apparatus defining a second fluid compartment, means within said tubular apparatus for separating fluids contained in said first and second compartments, means within said tubular apparatus including a sliding sleeve for displacing said separating means from the surface through said tubing, to permit admixture of the fluid in said first and second compartments, and an in-line mixer adjacent the lower end of said tubular apparatus for intimately mixing said admixture preparatory to injection of said mixture into a well zone.

27. Apparatus for admixing within a predetermined time span, two separated fluids downhole in a tubular apparatus in a cased well into which tubing extends within said casing, from the surface to said tubular apparatus, comprising:

a first fluid compartment extending within said tubular apparatus adjacent the lower end of said tubing;

means for injecting the first of said fluids through said tubing into said first fluid compartment;

a second fluid compartment within said tubular apparatus adjacent the lower end of said tubing;

means for injecting the second of said fluids through said tubing into said second fluid compartment;

means for separating fluids contained in said first and second compartments;

means actuatable from the surface through said tubing for displacing said separating means to permit admixture of said first and second fluids downhole, and means for intimately mixing said admixture prior to injection thereof into a predetermined well zone.

28. Apparatus for admixing within a predetermined time span, two separated fluids downhole in a tubular apparatus in a cased well into which tubing extends, within said casing, from the surface to said tubular apparatus, comprising:

a first fluid compartment within said tubular apparatus;

means for injecting the first said fluid into said first fluid compartment;

a second fluid compartment within said tubular apparatus;

means for injecting the second said fluid into said second fluid compartment;

means for separating said fluids contained in said first and second compartments;

said tubular apparatus including a sliding sleeve member arranged and constructed for displacing said separating means to admix said first and second fluids, and means for intimately mixing said admixture prior to injection into a predetermined well zone.

29. Apparatus for admixing within a predetermined time span, two separated fluids downhole in a cased well into which a tubing extends, within said casing, from the surface, comprising:

a ported tubular member affixed to the lower end of said tubing and in fluid communication with said tubing;

means in said ported tubular member defining a first fluid compartment;

means in said ported tubular member defining a second fluid compartment;

means for separating fluids contained in said first and second compartments;

a ported sliding sleeve movably disposed within said tubular member for displacing said separating means to admix said first and second fluids in said tubular apparatus, and means for intimately mixing said admixture prior to injection into a predetermined well zone.

* * * * *